United States Patent [19]

Münzing et al.

[11] Patent Number: 4,485,593

[45] Date of Patent: Dec. 4, 1984

[54] GRINDING MACHINE FOR CRANKSHAFT PINS

[75] Inventors: Rudolf Münzing, Frankfurt am Main; Dieter Lehmann, Dreieich, both of Fed. Rep. of Germany

[73] Assignee: Naxos-Union Schleifmittel und Schleifmaschinenfabrik, Fed. Rep. of Germany

[21] Appl. No.: 381,007

[22] Filed: May 21, 1982

[30] Foreign Application Priority Data

May 30, 1981 [DE] Fed. Rep. of Germany ..... 3121609

[51] Int. Cl.[3] ..... B24B 5/42; B24B 41/00

[52] U.S. Cl. ..... 51/105 SP; 51/58; 51/238 S; 409/199; 82/38 R

[58] Field of Search ..... 51/58, 105 SP, 105 EC, 51/238 S, 238 R, 101 R; 82/38 R, 38 A; 409/199

[56] References Cited

U.S. PATENT DOCUMENTS

| | | | |
|---|---|---|---|
| Re. 23,991 | 5/1955 | Balsiger et al. | 51/105 SP |
| 1,844,805 | 2/1932 | Sims | 51/238 S |
| 2,328,251 | 8/1943 | Balsiger | 51/105 SP |
| 2,547,529 | 4/1951 | Lichtenberg | 51/238 S |
| 3,548,546 | 12/1970 | Thielenhaus et al. | 51/58 |
| 4,292,766 | 10/1981 | Kirk et al. | 51/105 SP |

*Primary Examiner*—Robert P. Olszewski

*Attorney, Agent, or Firm*—Goodman & Teitelbaum

[57] ABSTRACT

Grinding machine for pins of heavy crankshafts on which the crankshaft is eccentrically mounted in a rotatable clamping arrangement on both sides, where the crankshaft pin to be ground is located in the rotational center of the clamping arrangement and on which the pin can be ground with a grinding head of a cylindrical grinder, with at least one relief arrangement for the crankshaft to supply an eccentrically rotating main bearing with constant, vertically applied force counteracting the dead weight of the crankshaft. The relief arrangement exhibits at least one relief bow for mounting of the main bearing to be supported whose suspension point essentially rotates in a location vertically above the main bearing and synchronously with equal eccentricity as the main bearing.

10 Claims, 2 Drawing Figures

GRINDING MACHINE FOR CRANKSHAFT PINS

BACKGROUND OF THE INVENTION

The present invention concerns a grinding machine for pins of heavy crankshafts on which the crankshaft is eccentrically mounted in a rotatable clamping arrangement at both ends, where the crankshaft pin to be ground is located in the rotational center of the clamping arrangement and on which the pin can be ground with a grinding head of a cylindrical grinder, the clamping arrangement being provided with at least one relief arrangement for the crankshaft to supply an eccentrically rotating main bearing with constant, vertically applied force counteracting the dead weight of the crankshaft.

During such grinding operations, the deflection of the crankshaft, eccentrically mounted on both ends, poses a problem when the crankshaft exceeds a certain length and/or weight. The deflection of the crankshaft, caused by its own weight, creates an elastic deformation in the area of the pin to be ground, thus not permitting the grinding operation to maintain the normally required tolerances in roundness and width. To decrease the tolerance deviations due to deflection, the pins to be ground can be supported with a steady. This provides acceptable grinding results in the center range of the crankshaft but exceeds permissible tolerances when grinding pins on both ends of the crankshaft. Due to the unfavorable leverage action, deflection can only be insufficiently prevented by supporting the outer pins in steadies. When grinding outside pins, it has been attempted—in addition to the steady located at the pin to be ground—to provide a rotating disc with eccentric bore and corresponding to the stroke in the center of the crankshaft and to fasten it in such a way that the outside diameter of the disc runs true and is possibly spring-loaded to an extent that it counteracts the deflection of the crankshaft. However, such a support cannot be used on modern and partly automatically operated pin grinding machines, because the disc has to be detached, readjusted and possibly completely removed when grinding a neighboring pin.

SUMMARY OF THE INVENTION

Therefore, the basis of the present invention is to advance the design of a grinding machine of this type in such a way that weight relief of the crankshaft is possible without parts being attached to the crankshaft.

This task is solved by the present invention so that the relief arrangement is equipped with at least one relief bow for mounting of the main bearing to be supported, the relief bow's suspension point essentially rotates in a location vertically above the main bearing and synchronously with equal eccentricity as the main bearing.

This relief arrangement is simple in design and also permits automatic operation of the pin grinding machine. The relief arrangement can act to support the dead weight of the crankshaft at each desired point of the crankshaft, where it can be moved axially relative to the crankshaft.

The suspension point can be provided with a pivot arm which is mounted to a support arm by a joint. This permits movement of the relief bow to the proper location relative to the main bearing to be supported.

When the suspension point is designed as a joint between the relief bow and the pivot arm, the relief bow can be swung side-ways under the main bearing to be supported.

For example, the support arm can be guided by at least one eccentric cam rotating synchronously with the crankshaft so that uniform support of the seat during rotation of the crankshaft is obtained.

For proper development of the present invention, a motor, for example, a D.C. servo-motor, synchronized with the crankshaft, serves the drive especially at least the one eccentric cam guiding the support arm.

When, for special development of the present invention, the pivot arm is mounted to the support arm by hydraulically or pneumatically actuated piston-cylinder arrangement to allow the pivot arm to pivot upward, thus adjustment to the dead weight of the crankshaft to be supported can be obtained in a simple way.

When, according to still further development of the present invention, the relief bow is mounted on the support arm by hydraulically or pneumatically actuated piston-cylinder arrangement to allow movement of the relief bow to the side by pivoting at the suspension point designed as a joint, thus the relief bow can be swung sideways from the range of the crankshaft and the complete relief arrangement can be axially moved to a different position relative to the crankshaft.

Furthermore, it is practical to equip the relief bow with rolls to receive the crankshaft weight at the main bearing to be supported to assure trouble-free operation of the relief arrangement.

Additional objectives, characteristics, advantages and possibilities of application of the present invention are demonstrated in the following description of a design example based on the attached drawing. All characteristics described and/or illustrated, by themselves or in meaningful combination, form the object of the present invention.

DESCRIPTION OF THE PREFERRED EMBODIMENT

Figure 1:
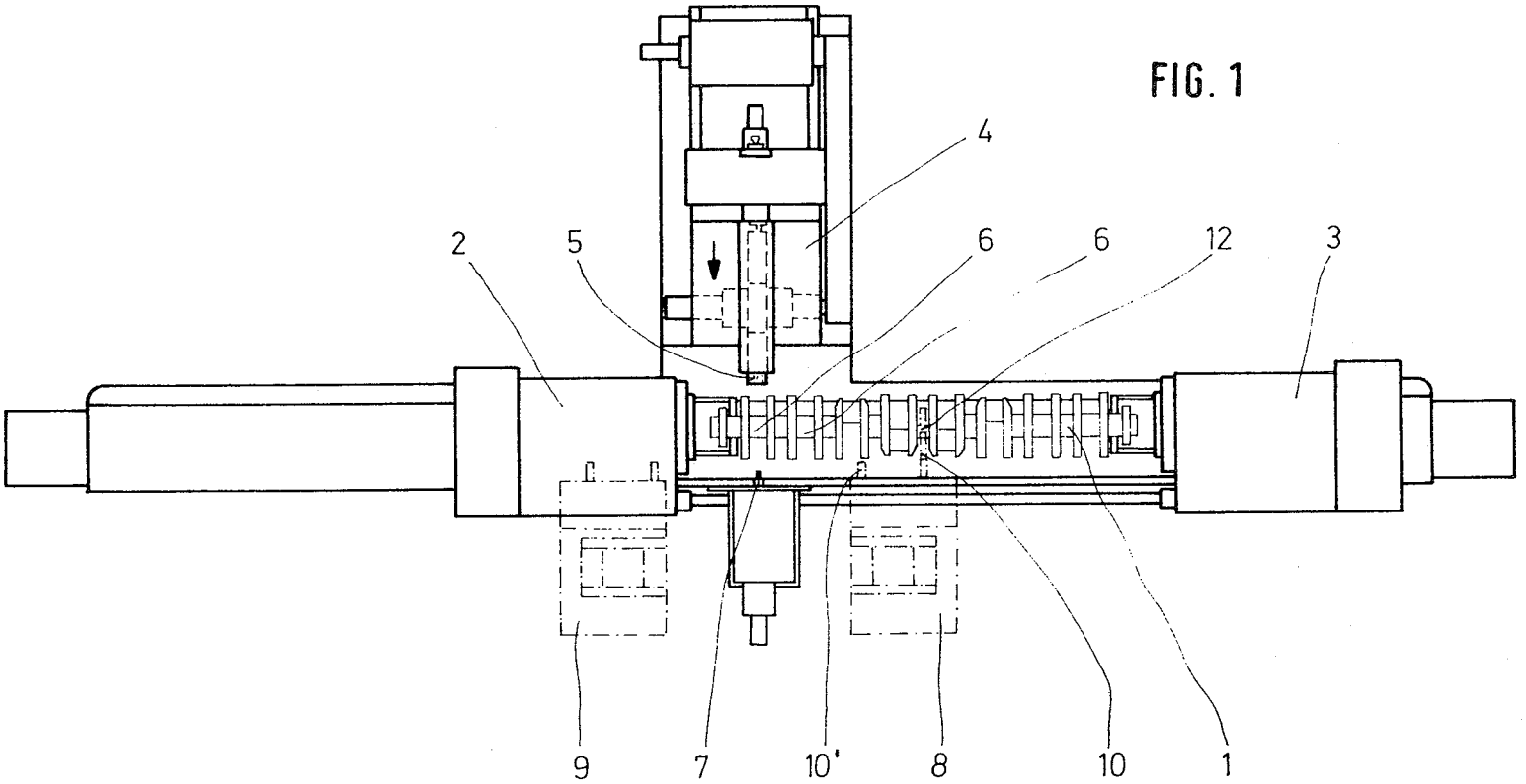
FIG. 1 is a plan view of the grinding machine showing the present invention.

FIG. 1 illustrates a crankshaft 1 mounted on both ends in clamping heads 2 and 3. Grinding head 4 is adjustable (direction of arrow) to the workpiece axis and grinds, with its grinding wheel 5, pin 6 of the rotating crankshaft 1. Pin 6 is supported by steady jaw 7, movable towards pin 6 to be ground, against the generated grinding pressure. A second steady jaw (not shown) supports pin 6 from the bottom during grinding. To avoid deflection of crankshaft 1 and with it the pitch of pin 6 to be ground due to the crankshaft weight, relief arrangement 8 with relief bow 10 is engaged at the eccentrically rotating center main bearing 12. Relief bow 10 can be moved in relief arrangement 8 parallel to the axis of crankshaft 1 to position 10' to facilitate weight relief on crankshaft 1. A second, laterally reversed relief arrangement 9, can be provided symmetrically to the grinding wheel to also relieve crankshaft 1 at center main bearing 12 when pin grinding the other end of the crankshaft.

Figure 2:
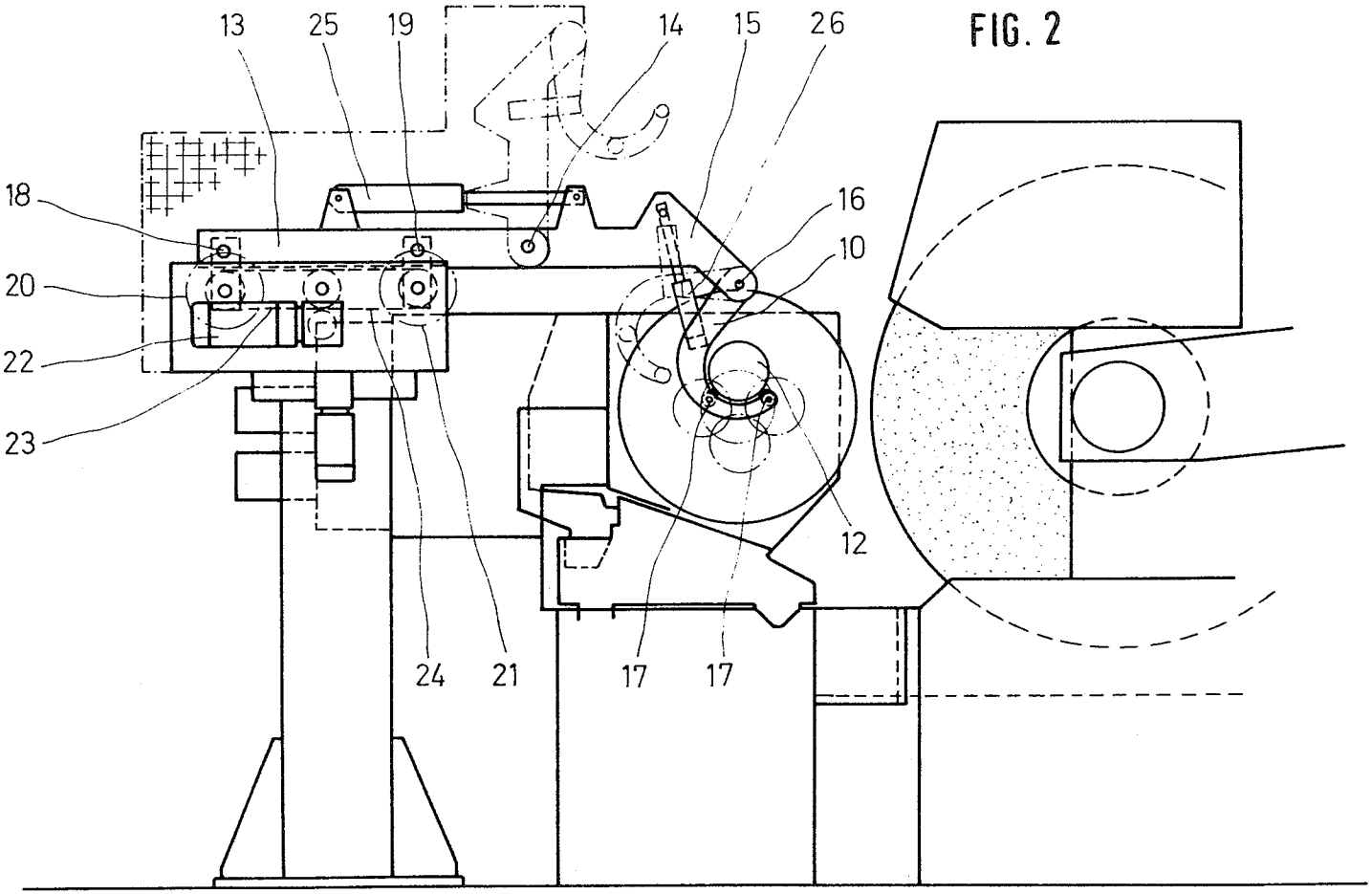
FIG. 2 is a cross section of the grinding machine based on FIG. 1.

FIG. 2 illustrates the method of operation, design and construction of the relief arrangement 8 in detail. Pivot arm 15 by a joint 14 is mounted to a basically horizontal support arm 13 from which relief bow 10 is suspended through suspension point 16 designed as a joint. The relief bow 10 receives the weight of crankshaft 1 at the center main bearing 12 for supporting one of the eccentrically rotating main bearings of the crankshaft on the rolls 17. Because the supported center main bearing 12 rotates eccentrically around the rotational center of pin 6, support arm 13 with pivot arm 15 and relief bow 10 follow the eccentrically rotating position of the center main bearing 12 of crankshaft 1 to assure the relief effect in every rotational position of crankshaft 1 when grinding pin 6. For this purpose, support arm 13 is mounted in and guided by two rotating eccentric cams 18 and 19 which have the same eccentricity as center main bearing of 12 crankshaft 1. Eccentric cams 18 and 19 are carried on synchronously running face plates 20 and 21. Face plates 20 and 21 are driven by servo-motor 22 over chains 23 and 24. The face plate drive is electronically synchronized to the rotation of crankshaft 1 in clamping heads 2 and 3. With the aid of a hydraulically or pneumatically actuated piston-cylinder arrangement 25, the relief force can be matched to the weight of crankshaft 1 by means of pressure adjustment over pivot arm 15. In addition, hydraulically or pneumatically actuated piston-cylinder arrangement 25 serves, if necessary together with hydraulically or pneumatically actuated piston-cylinder arrangement 26, to swing relief bow 10 to a position (illustrated in dotted lines) in which the relief arrangement 8 can be shifted sideways parallel to the axis of the crankshaft.

What is claimed is:

1. A grinding machine for pins of heavy crankshafts on which a crankshaft is eccentrically mounted in a rotatable clamping arrangement at both ends, a first pin of the crankshaft to be ground being located in a rotational center of the clamping arrangement where the first pin can be ground with a grinding head of a cylindrical grinder, said grinding machine comprising:

at least one relief arrangement for the crankshaft for supporting an eccentrically rotating main bearing of the crankshaft:

said main bearing rotating eccentrically with constant, vertically applied force by said relief arrangement counteracting the dead weight of the crankshaft at said main bearing;

said relief arrangement including at least one relief bow for supporting the main bearing of the crankshaft;

said relief bow being provided with a suspension point essentially rotating in a location vertically above said main bearing and synchronously with equal eccentricity as the main bearing;

said suspension point being provided on a pivot arm;

said pivot arm being mounted on a support arm by a joint; and said support arm being guided by at least one eccentric cam, said eccentric cam rotating synchronously with the crankshaft.

2. A grinding machine according to claim 1, wherein said suspension point provides a joint between said relief bow and said pivot arm.

3. A grinding machine according to claim 1, wherein said suspension point and said eccentric cam guiding said support arm are driven by a servo-type D.C. motor synchronized with the crankshaft.

4. A grinding machine according to claim 1, wherein a piston-cylinder arrangement pivots said pivot arm upwards relative to said support arm to a position over said joint which mounts said pivot arm on said support arm.

5. A grinding machine according to claim 4, wherein said piston-cylinder arrangement is hydraulically actuated.

6. A grinding machine according to claim 4, wherein said piston-cylinder arrangement is pneumatically actuated.

7. A grinding machine according to claim 1, wherein a piston-cylinder arrangement pivots said relief bow relative to said pivot arm with said suspension point providing a joint between said relief bow and said pivot arm.

8. A grinding machine according to claim 7, wherein said piston-cylinder arrangement is hydraulically actuated.

9. A grinding machine according to claim 7, wherein said piston-cylinder arrangement is pneumatically actuated.

10. A grinding machine according to claim 1, wherein said relief bow includes rolls to receive the weight of the crankshaft at said main bearing to support the crankshaft.

* * * * *